US005952604A

United States Patent [19]

Helander

[11] Patent Number: 5,952,604

[45] Date of Patent: Sep. 14, 1999

[54] SHELL WITH MULTI-CHARGES

[75] Inventor: Jyrki Helander, Eskilstuna, Sweden

[73] Assignee: Bofors AB, Karlskoga, Sweden

[21] Appl. No.: 09/004,338

[22] Filed: Jan. 8, 1998

[51] Int. Cl.[6] ..... F42B 12/18

[52] U.S. Cl. ..... 102/476; 102/308

[58] Field of Search ..... 102/306, 308, 102/310, 473, 476, 478, 479

[56] References Cited

U.S. PATENT DOCUMENTS

| | | | |
|---|---|---|---|
| 4,854,240 | 8/1989 | Hirsch et al. | 102/308 |
| 5,166,469 | 11/1992 | Kerdraon et al. | 102/476 |
| 5,565,647 | 10/1996 | Kerdraon et al. | 102/476 |
| 5,686,692 | 11/1997 | Watson, Jr. | 102/479 |

FOREIGN PATENT DOCUMENTS

| | | | |
|---|---|---|---|
| 2552870 | 4/1985 | France | 102/476 |
| 2603375 | 3/1988 | France | 102/476 |
| 24 60 303 | 10/1978 | Germany . | |
| 3540021 | 5/1987 | Germany | 102/476 |
| 3601051 | 6/1987 | Germany | 102/476 |
| 3605580 | 6/1987 | Germany | 102/476 |

*Primary Examiner*—Harold J. Tudor
*Attorney, Agent, or Firm*—Pollock, Vande Sande & Amernick

[57] ABSTRACT

A joint for a shell with at least a first charge unit and a second charge unit arranged in series one after the other is provided. The charge units include one shaped charge each. The charges are designed to be detonated one after the other with a time separation between the detonations. In order to suppress the interference to an undetonated charge by a shock wave generated by the detonation of a previously detonated charge, the joint that connects the charge units has been designed in a special way. The joint includes a damping section parallel to the longitudinal axis of the device, that mechanically fastens together the two charge units. In addition a rigid support device is connected to the damping section and dimensioned so that when the damping section is in an unstressed state there is a clearance in the longitudinal axis of the device between the two charge units.

7 Claims, 2 Drawing Sheets

SHELL WITH MULTI-CHARGES

BACKGROUND OF THE INVENTION

This invention concerns a device, such as a shell or the like, containing at least a first charge unit and a second charge unit arranged in series one after the other and connected to each other by means of a joint. These charge units contain one RSV i.e. shaped charge each and are designed to be detonated one after the other with a time separation between the detonations.

The number of RSV or shaped charges contained in a shell can be two or more. Versions with two RSV charges are called tandem RSV charges, while versions with three RSV charges are called triple RSV charges. A collective name for versions with more than one RSV charge is multi RSV charges.

A shell in accordance with the above paragraph is already known by, for example, DE publication 24 60 303. In this document some tandem RSV designs are described. In particular it mentions the undesirable effect that a detonating charge can have upon undetonated charges.

One problem concerning the design of RSV charges that are to detonate at different times is, as already mentioned, the effect that a detonating charge has upon the undetonated charges. Normally the structure that lies between the charges is designed to be so strong that it can support the mass in front of it during the launching stage. Designs with such a strong structure have, however, the disadvantage that they act as excellent shock wave transmitters. A shock wave generated by the detonation of a first charge is therefore transmitted almost undamped to subsequent charges. This in turn can cause interference to the RSV beams received by a subsequent charge or even cause its ignition system to be damaged.

SUMMARY OF THE INVENTION

The aim of this invention is to make a device, such as a shell or the like, that does not exhibit the problem described above with interference caused by a shock wave generated by a previous detonation.

The aim of the invention is achieved by means of a device characterized in that the joint between two charge units that are to be detonated at separate times includes a spring damping section parallel to the longitudinal axis of the device that mechanically fastens together the two charge units and a rigid support device connected to the damping section and dimensioned so that when the damping section is in an unstressed state there is a clearance in the longitudinal axis of the device between the two charge units. The invention thus achieves a simple way of attenuating the shock waves that cause interference by means of the interaction between a damping section and a support device that falls away after the launching stage.

According to an advantageous embodiment version the device is characterized in that a spring device is designed to operate between the damping section and the support device. In this way it is ensured that the support device separates from the damping section in a simple and reliable way after the launching stage. The spring device can consist of plate springs.

According to another advantageous embodiment the support device includes of a number of separate support elements positioned around the damping section. The support elements can thereby be designed as longitudinal casing sections. The support elements give the structure the requisite strength during the launching stage, are simple to manufacture and can be easily separated after the launching stage.

According to a embodiment that is reliable and easy to assemble, the damping section is connected to the charge units by threaded connectors.

In order to create good interaction between the support device and the charge units, according to a further embodiment the rear part of a front charge unit and the front part of a rear charge unit which are connected by means of a damping section are provided with contact surfaces for interaction with the support device.

BRIEF DESCRIPTION OF THE DRAWING

This invention will be described in greater detail by means of one version as an example with reference to the attached drawings, where.

DETAILED DESCRIPTION OF THE INVENTION

Figure 1:
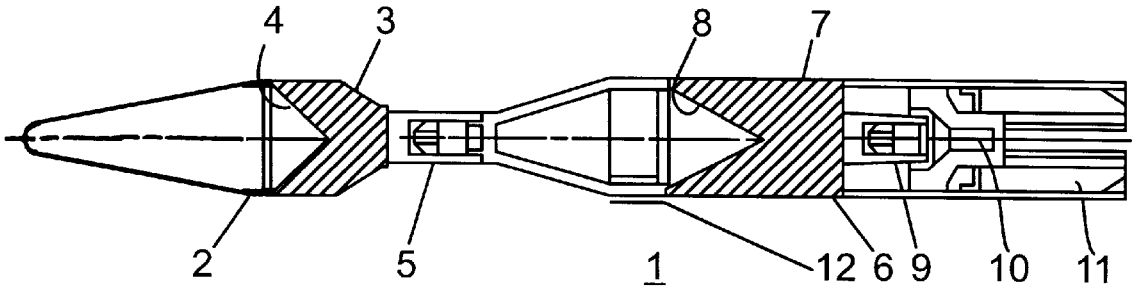
FIG. 1 shows a shell according to the invention with tandem RSV charges.

The shell [1] in FIG. 1 contains a first charge unit [2] containing an RSV charge [3] with liner [4]. In the rear part of the charge unit there is an SA unit 5 (Safety Ammunition Unit) that among other things provides safety and arming functions. The shell also contains a second charge unit [6] containing an RSV charge [7] with liner [8] and an SA unit [9]. At the very rear of the shell there is a rocket motor [10] for launching the shell and a collapsible fin assembly [11]. The charge units are connected by a joint [12].

Figure 2:
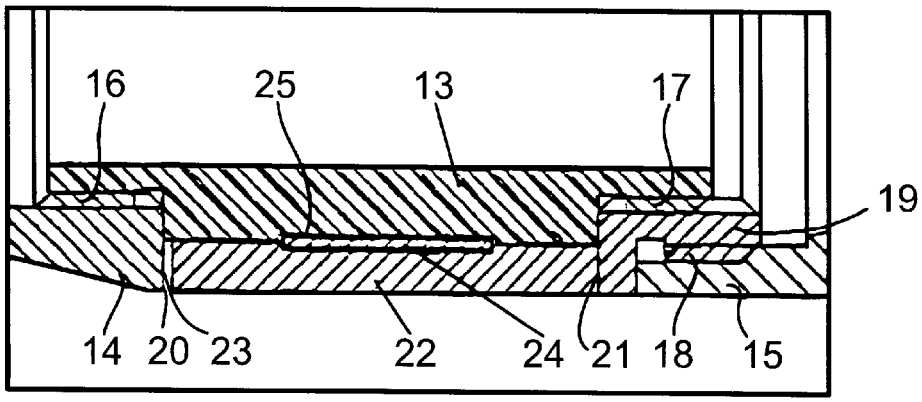
FIG. 2 shows in greater detail the joint between the charge units in which the RSV charges are contained.
Figure 3:
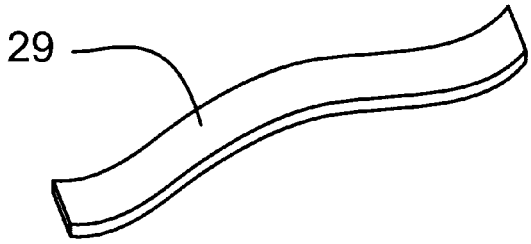
FIG. 3 shows a plate spring.
Figure 4:
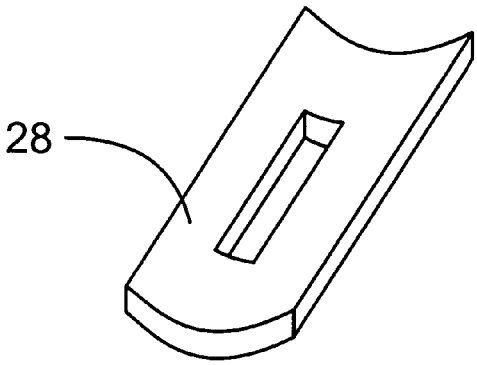
FIG. 4 shows one of the separate support elements.

The joint [12] is shown in greater detail in FIG. 2. A spring damping section [13], preferably made of a plastic material, joins together the rear part [14] of the first, front charge unit [2] and the front part [15] of the second, rear charge unit [6]. The damping section [13] is connected to the charge units via threaded connectors [16], [17] and [18]. In the version shown, a casing [19] with internal and external threads provides the connection to the second charge unit [6]. The rear part [14] of the first charge unit is provided with a contact surface [20]. In a corresponding way the casing [19] is provided with a front contact surface [21]. Between the contact surfaces [20] and [21] there is a rigid support device [22]. The support device can consist of several separate support elements 28 constructed as longitudinal casing sections as shown in FIG. 4. In the unstressed state depicted, there is a clearance [23] for the support device between the two contact surfaces [20], [21]. Between the damping section [13] and the support device [22] there is a space [25] that contains a spring device [24]. The spring device [24] may be plate springs 29 of a known type as shown in FIG. 3.

During the activation stages of the shell [1], the joint [12] works as follows. When the shell is subjected to the launch acceleration, the damping section [13] is compressed longitudinally. The clearance [23] disappears and the rigid support device [22] comes into direct contact with the contact surfaces [20], [21]. This means that a rigid construction is achieved that is able to support the mass in front of it. Later when the launch acceleration ceases, which normally occurs only after the shell has left the barrel, the damping section [13] springs out again. This means that the clearance [23] reappears and the support device is no longer held fast between the contact surfaces [20], [21].

The support device [22] can now be separated from the shell [1] by the action of the spring device [24]. Thereby the connection between the charge units [2], [6] has been made as weak as possible for the requirements that are made of the connection for holding the shell together during the transportation of the shell at the airfield. Normally no great strength is required for this holding-together function. The weakened connection between the charge units following the launch means that only a very small part of the shock wave from a detonation is transmitted to a charge that is to detonate at a later time. Dynamic and static tests have been carried out that confirm the above.

This invention is in no way limited to the version described in the example, but can contain a number of modifications within the framework of the invention as defined by the patent claims. For example, it could be possible to have versions with more than two RSV charges. In addition, the design of the support device and the spring device can be modified. Instead of threaded connections the charge units can, for example, be glued or molded together.

I claim:

1. A shell comprising a joint connecting a first charge unit and a second charge unit connected in series, the charge units including one shaped charge each to be detonated one after the other with a time separation between the detonations, the joint comprising:

a damping section arranged parallel to a longitudinal axis of the shell and fastening the charge units together; and a rigid support device arranged between the charge units and connected to an outer surface of the damping section, the rigid support device being dimensioned so that when the damping section is in an unstressed state there is a clearance between the rigid support device and at least one of the charge units in a longitudinal direction and so that it provides support between the charge units during launch and disengages from the damping section after launch.

2. A shell according to claim 1 further comprising a spring device between the damping section and the support device.

3. A shell according to claim 2, wherein the spring device comprises plate springs.

4. A shell according to claim 1 wherein the support device comprises a number of separate support elements positioned around the damping section.

5. A shell according to claim 4, wherein the support elements are longitudinal casing sections.

6. A shell according to claim 1 wherein the damping section is connected to the charge units by threaded connectors.

7. A shell according to claim 1 wherein the rear part of a front charge unit and the front part of a rear charge unit, which are connected by the damping section, are provided with contact surfaces for interaction with the support device.

* * * * *